US008820100B2

(12) United States Patent
Culley et al.

(10) Patent No.: US 8,820,100 B2
(45) Date of Patent: Sep. 2, 2014

(54) APPARATUS, METHOD, AND SYSTEM FOR AUTOMATICALLY TURNING OFF AN ACTUATOR IN A REFRIGERATION DEVICE UPON DETECTION OF AN UNWANTED CONDITION

(75) Inventors: Brian Keith Culley, Mount Vernon, IN (US); Patrick J. Boarman, Evansville, IN (US); Ronald L. Voglewede, Saint Joseph, MI (US); Randell L. Jeffery, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 343 days.

(21) Appl. No.: 11/933,761

(22) Filed: Nov. 1, 2007

(65) Prior Publication Data

US 2008/0156011 A1 Jul. 3, 2008

Related U.S. Application Data

(60) Provisional application No. 60/882,636, filed on Dec. 29, 2006, provisional application No. 60/890,107, filed on Feb. 15, 2007.

(51) Int. Cl.
*F25C 1/00* (2006.01)

(52) U.S. Cl.
USPC ..... 62/137; 62/340; 62/344

(58) Field of Classification Search
USPC ..... 62/137, 344, 320; 221/13, 14, 33, 59; 250/221, 221.1, 221 R
See application file for complete search history.

(56) References Cited

U.S. PATENT DOCUMENTS

| | | | | |
|---|---|---|---|---|
| 3,640,089 | A * | 2/1972 | Frazier | 62/320 |
| 4,248,276 | A * | 2/1981 | Gosnell | 141/87 |
| 4,771,609 | A * | 9/1988 | Funabashi | 62/137 |
| 5,000,345 | A | 3/1991 | Brogna et al. | |
| 5,542,265 | A | 8/1996 | Rutland | |
| 5,573,041 | A | 11/1996 | Skell et al. | |
| 5,922,030 | A * | 7/1999 | Shank et al. | 222/56 |
| 6,082,419 | A | 7/2000 | Skell et al. | |
| 6,314,745 | B1 | 11/2001 | Janke et al. | |
| 6,442,954 | B1 * | 9/2002 | Shapiro et al. | 62/137 |
| 6,688,499 | B2 | 2/2004 | Zhang | |
| 7,028,725 | B2 | 4/2006 | Hooker | |
| 7,084,643 | B2 | 8/2006 | Howard et al. | |
| 7,129,490 | B2 * | 10/2006 | Olson et al. | 250/341.1 |
| 2001/0039804 | A1 | 11/2001 | Newman et al. | |
| 2008/0156005 | A1 | 7/2008 | Culley et al. | |

* cited by examiner

*Primary Examiner* — Cassey D Bauer

(57) ABSTRACT

An apparatus, method, and system for automatically turning off an electrically powered actuator in a refrigeration mechanism upon detection of an unwanted condition. In one aspect of the invention, the electrically powered actuator can be the motor of an ice maker/dispenser. The detection can be accomplished by sensing the presence of an object along or near an ice dispensing pathway from the ice maker/dispenser. The unwanted condition could be the presence of the object for more than a preset time period. This would allow to distinguish between an unwanted object such as silverware or clogged ice versus a wanted object such as flowing ice cubes, crushed ice, or shaved ice.

13 Claims, 7 Drawing Sheets

APPARATUS, METHOD, AND SYSTEM FOR AUTOMATICALLY TURNING OFF AN ACTUATOR IN A REFRIGERATION DEVICE UPON DETECTION OF AN UNWANTED CONDITION

CROSS-REFERENCE TO RELATED APPLICATION

This application claims the benefit of U.S. provisional application Ser. Nos. 60/882,636, filed Dec. 29, 2006, and 60/890,107, filed Feb. 15, 2007, which is incorporated herein in its entirety.

BACKGROUND OF THE INVENTION

1. Field of the Invention

The present invention relates to refrigeration mechanisms and, in particular, to such mechanisms that include electrically powered actuators.

2. Description of the Related Art

Modern refrigeration mechanisms, such as refrigerator/freezer units, have electrically powered actuators that perform a variety of functions. An example is an ice maker/dispenser. Normally, electrical motors perform functions such as operating valves to supply water to the ice maker, moving a rod or rack to eject ice that has been frozen from supplied water, and moving other structure to move, alter, or direct ice pieces to an ice delivery or dispensing chute.

In the case of an ice maker/dispenser, the user normally must manually push a button with a finger or move a glass or container against a lever to actuate the motors to dispense ice down the chute. In some models, the user can also manually push a button to select between ice cubes or crushed ice, and in some instances shaved ice. Normally, once actuated, the dispenser operates until the user releases the button or lever. In some cases, the dispenser motor continues until automatically stopped by a timer.

In either of these cases, there are situations where it may be desirable to automatically stop the dispensing motor even if the user has instructed it to continue. For example, if ice jams or clogs the ice dispensing chute, the user may continue to try to operate the dispensing motor. Ice would back up and potentially damage the system. Additionally, if a foreign object (a non-ice object) enters the chute, it would be advantageous to automatically detect the same and stop operation of the dispensing motor until the situation can be resolved.

Furthermore, maintenance is some times performed on the ice chute, or at or near the ice chute. It could be advantageous to disable the dispensing motor automatically. There are other reasons to stop moving parts, such as are obvious to those skilled in the art.

There can be other actuators in the form of motors, valves, fans, etc. that are electrically powered and may have moving parts or cause certain functions where it would be advantageous to have some sort of backup or failsafe automatic protection to disable or shut off the actuator for unwanted conditions.

SUMMARY OF THE INVENTION

It is therefore a principle object, aspect, feature and/or advantage of the present invention to provide an apparatus, method, and system which improves over or solves the problems and deficiencies in the art.

Further objects, aspects, features, and/or advantages of the present invention include, but are not limited to, an apparatus, method, or system for automatically detecting and disabling or turning off an electrically powered actuator in a refrigeration mechanism which:

a. prevents tampering, damage, or breakage of components of the refrigeration mechanism;

b. detects the difference between conditions indicative of an unwanted condition from a wanted condition for the refrigeration mechanism;

c. is robust, and durable, particularly in the environment of a refrigeration unit, where there can be a range of temperatures and moisture content;

d. detects ice and non-ice objects;

e. does not require contact with an object to sense an unwanted condition; and f. is efficient and relatively economical.

A method according to one aspect of the invention comprises providing an electrically-powered actuator in a refrigeration mechanism, sensing the presence of an object along or a near sensing location, and turning off or disabling the actuator if the sensed presence of an object is indicative of an unwanted condition.

An apparatus according to an aspect of the present invention comprises a refrigeration mechanism with an electrical powered actuator, a sensor producing an electrical output signal in response to sensitivity to a measured property, the measured property comprising presence of an object at or near a sensing location; a control operatively connected to the sensor and the actuator, the controller issuing an instruction to stop or disable operation of the actuator based upon a parameter of the measured property of the sensor.

Another aspect of the present invention comprises a method or apparatus where the measured property comprises presence of an object at or near the sensing location and a parameter of the measured property is length of time of presence of the object at the sensing location.

A further aspect of the present invention is an apparatus or method as above described wherein the measured property of the sensor is transduced by measuring attenuation of the energy or agent capacitance of an electromagnetic field.

Another aspect of the present invention is a refrigeration mechanism comprising an ice maker including an electrically powered actuator, a dispensing chute, a sensor producing an electrical output signal in response to a measured property comprising presence of an object along or near an ice dispensing pathway defined by the ice dispensing chute, a controller connected to the sensor and actuator and adapted to issue an instruction to stop or disable operation of the actuator based on cumulative time of presence of an object at or near the ice dispensing pathway.

These and other objects, aspects, features, or advantages of the present invention will become more apparent with reference to the accompanying specification.

DETAILED DESCRIPTION OF PREFERRED EMBODIMENTS

Figure 1:
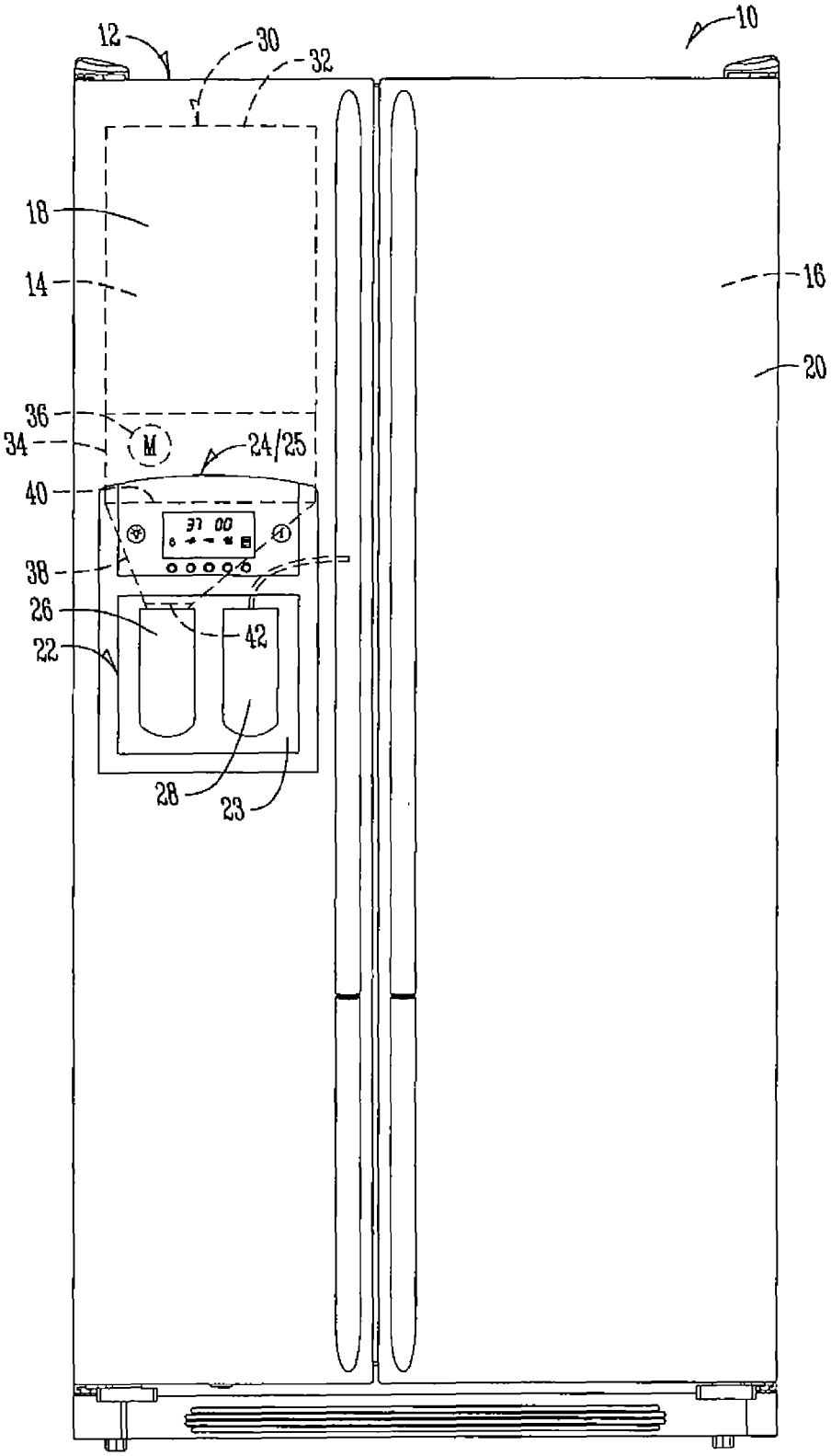
FIG. 1 is a front elevation view of a refrigeration mechanism comprising a side-by-side refrigerator/freezer with an ice and water dispenser.

For a better understanding of the invention, one form the invention can take will now be described in detail. Frequent reference will be taken to the appended drawings. Reference numerals or letters will be used to indicate certain parts or locations in the drawings. The same reference numerals or letters will be used to indicate the same parts and locations throughout the drawings unless otherwise indicated.

This exemplary embodiment of the invention will be described in the context of implementation with an ice maker/dispenser (indicated generally at reference numeral 30 in FIG. 1) of a side-by-side refrigerator/freezer (indicated generally by reference numeral 10 in FIG. 1). Refrigerator/freezer 10 has a housing that defines, on its left side, a freezer compartment 14 that is accessible by door 18 and, on its right side, a refrigeration compartment 16 accessible by door 20.

Door 18 includes ice/water dispensing station 22, allowing a user to obtain ice or water through door 18 without opening either door to refrigerator/freezer 10. Such ice/water dispensers are commonly available in a variety of commercial, residential refrigerator/freezer appliances. One example is Whirlpool® Gold® Models, Whirlpool Corp., Benton Harbor, Mich., USA.

In this exemplary embodiment, dispensing station 22 includes a recessed chamber 23 and a floor on which a container such as a glass or cup can be supported. User control panel 24 allows manual selection between modes of operation. In this example, control panel 24 could communicate with a controller 25 (in this example controller 25 could be housed behind user control panel 24) which is, in turn, adapted to control a variety of operations of refrigerator/freezer 10. For example, dispensing levers 26 (for ice) and 28 (for water) could be operatively connected to electrical switches such that when a glass is pushed against either lever, controller 24 would recognize and actuate the appropriate component to provide the selected product (ice or water).

FIG. 1 shows in ghost lines the position of an ice maker/dispenser 30 (at least partially built into the back of door 18). An ice bucket or container 32 is positioned above ice dispenser/crusher/shaver 34, which can be actuated by motor 36 that is controlled by controller 24. Indicated diagrammatically at reference numeral 38, an ice dispensing chute 38 has an inlet or feed end 40 beneath the ice dispenser 34 and funnels to an exit or dispensing end 42 right above ice dispensing lever 26 at dispensing station 22. In this manner, ice from ice maker 30 can be accumulated and stored in ice bucket 32. Upon actuation of motor 36 by controller 24, ice, in the form selected by the user at control panel 24, is delivered into the top or inlet end 40 of ice dispensing chute 38 and then falls and is focused by gravity and chute 38 to exit dispensing end 42 of chute 38, usually into a glass or container pressed against ice dispensing lever 26.

Motor 34 would continue operation and continue to feed ice through chute 38 so long as ice dispensing lever 26 is depressed. The dispensing would cease and operation of motor 34 would cease when the user releases pressure against ice dispensing lever 26.

In this example, the user can select from control panel 24 whether the ice is delivered in cube form as it exists in ice bucket 32, or whether it is crushed or perhaps shaved by means well known in the art caused by operation of motor 34.

The foregoing is conventional in the art.

Figure 2:
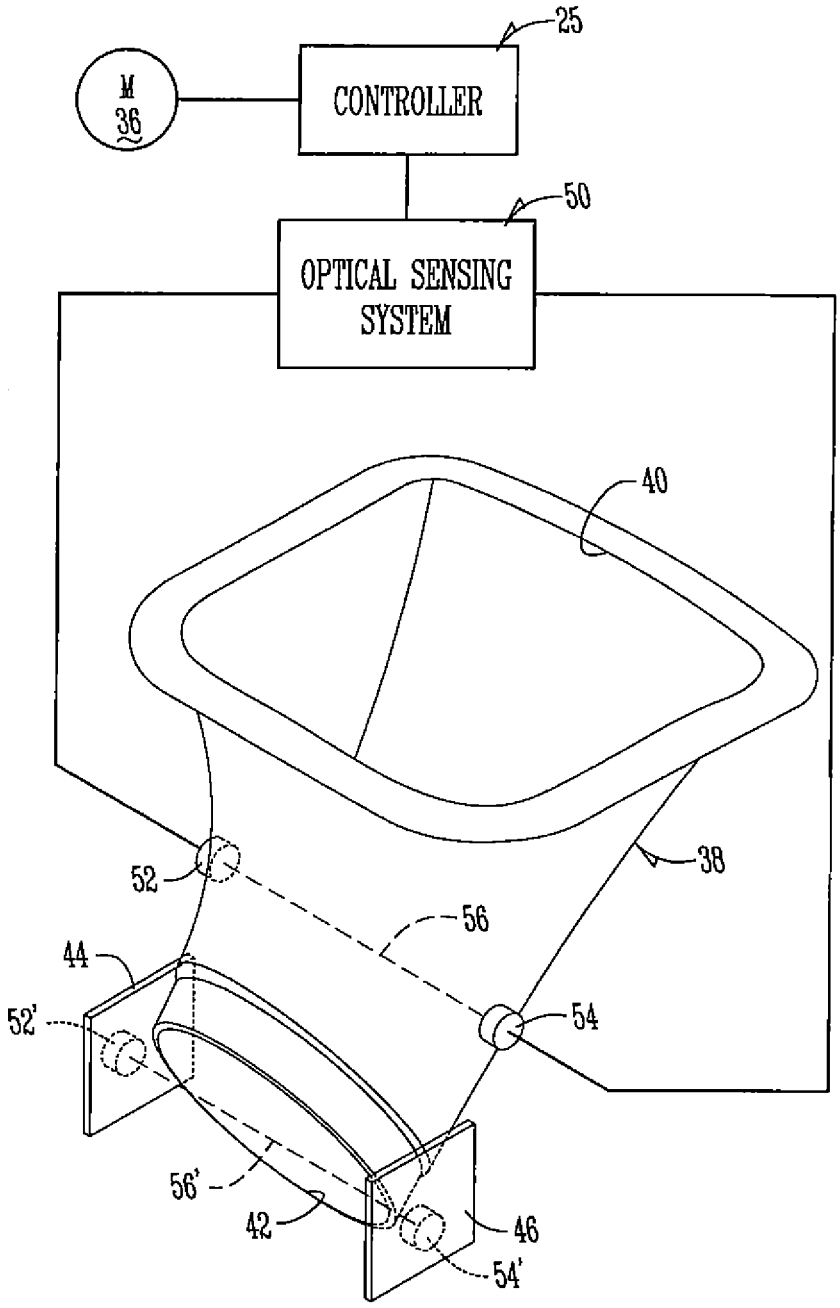
FIG. 2 is an enlarged isolated perspective view of an ice dispensing chute for delivering ice to the dispensing station of the refrigerator of FIG. 1, further showing diagrammatically an optical sensing system in operative communication with a controller and actuator (an ice maker/dispenser) of the refrigeration mechanism of FIG. 1.
Figure 3:
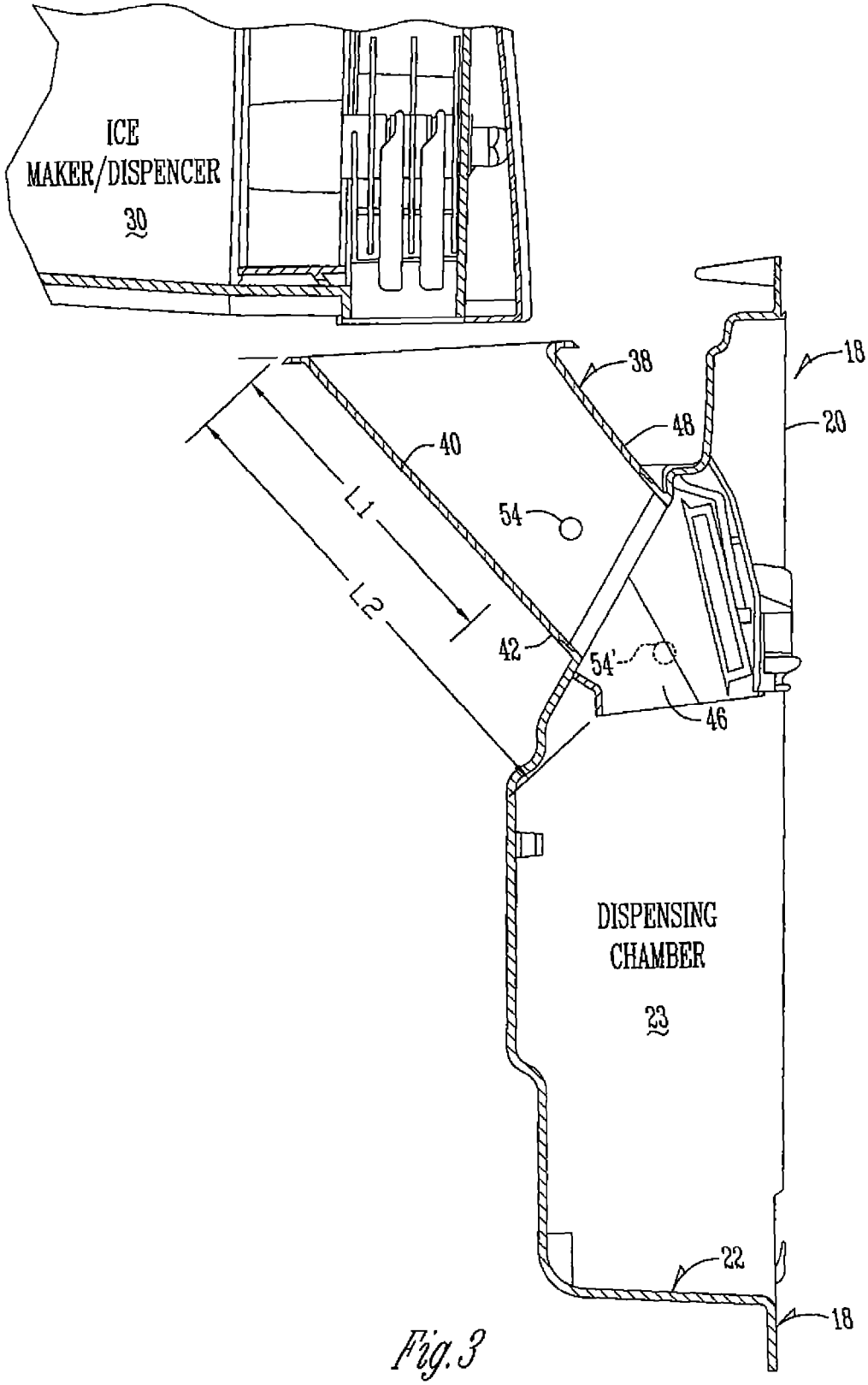
FIG. 3 is an enlarged side sectional view of the ice and water dispensing station of the refrigeration mechanism of FIG. 1 showing schematically an ice maker above the ice dispensing chute.

FIGS. 2 and 3 illustrate an apparatus according to one aspect or exemplary embodiment of the present invention. An optical sensing system (referred to generally as reference numeral 50 in FIG. 2) includes light energy emitter 52 and a complementary light energy detector 54 aligned on opposite sides of ice dispensing chute 38. Emitter 52 directs a light energy beam across the interior of chute 38. System 50 is in a normal configuration so long as nothing blocks or attenuates beam 56 below a threshold. However, if an object blocks or sufficiently attenuates beam 56, optical sensing system 50 issues an output signal to controller 25. Controller 25 therefore is provided with the information that attenuation of beam 56 exceeds a predetermined calibrated threshold and assumes the presence of an object at that location of chute 38. According to a programmed algorithm, controller 25 then monitors optical sensing system 50. If a parameter of the algorithm occurs, controller 25 can automatically disable or discontinue operation of motor 36. The algorithm will be described in more detail later.

It can therefore be seen that the inclusion of optical sensing system 50 provides an automated method of detecting the presence of an object in ice dispensing chute 38 and providing controller 25 with information it can use to determine if an unwanted condition in chute 38 exists, such that automatic shutoff of dispensing motor 36 is indicated.

FIGS. 2 and 3 illustrate emitter and detector pair 52/54 positioned intermediate between entry opening 40 and exit opening 42 of chute 38. More particularly, it is indicated as being closer to exit end 42 than entry end 40. It is to be appreciated, however, that the emitter/detector pair 52/54 could be placed anywhere along entry 40, which defines an ice dispensing pathway.

FIGS. 2 and 3 illustrate an alternative placement for the emitter/detector pair. An emitter/detector pair 52'/54' could be placed outside of chute 30. In FIG. 2, structure (fins 44 and 46) extends away from exit opening 42. Alternative emitter/detector pair 52'/54' could be placed slightly spaced apart from exit end 42 of chute 38. It can be appreciated the emitter/detector pair could be placed almost anywhere along the dispensing path, and, as indicated, inside or outside of chute 38.

Figure 4:
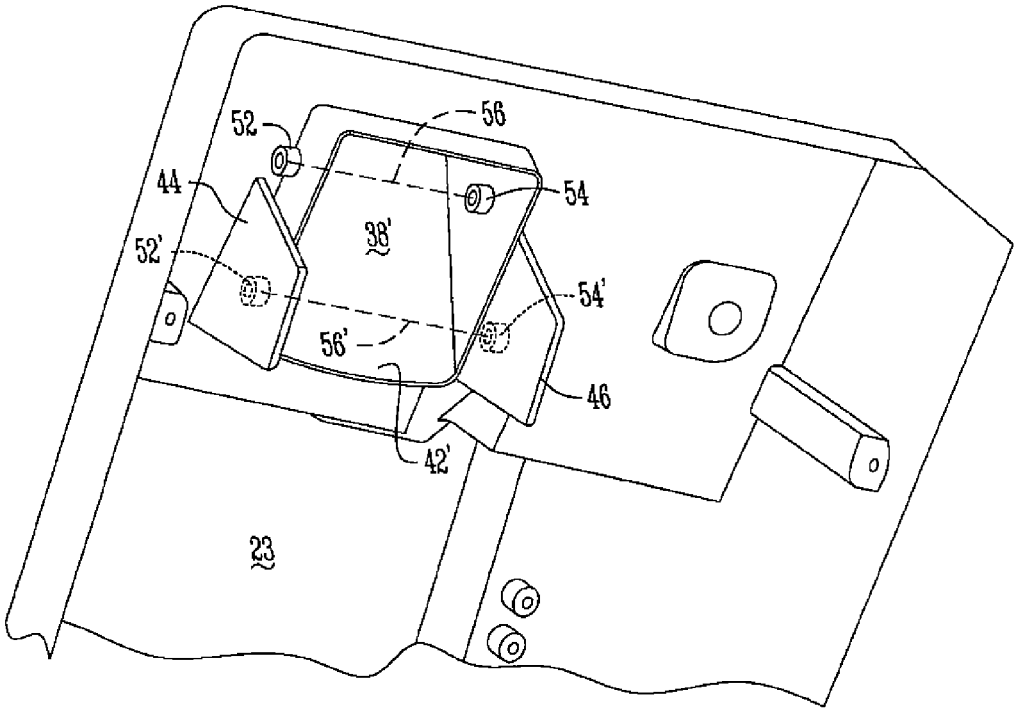
FIG. 4 is a perspective view of the exit opening of an alternative embodiment of an ice dispensing chute at a dispensing station.

FIG. 4 shows an alternative embodiment of an ice dispensing chute (see reference numeral 38'). Its dispensing or exit end 42' is square-shaped. Emitter 52/detector 54 can be inside chute 38. Housing fins 44 and 46 extend from exit end 42'. Alternative emitter/detector pair 52'/54' could be placed so that its beam 56' is actually spaced away from but in front of the exit end 42'. The sensor normally will be placed somewhere along or near the dispensing chute or dispensing pathway. A purpose for placing it in the position shown for emitter 52'/detector 54' is illustrated at reference numbers L1 and L2 in FIG. 3. Placement of sensor pair 52'/54' outside dispensing end 42 of chute 38 would shut motor 36 off sooner upon detection of an unwanted object from the direction of dispensing chamber 23 because it would "see" or sense the object sooner than if sensor pair 52/54 (inside chute 38) were used. It would start the timing period sooner, because it would trigger when the object is sensed at the lower end of the length L2. If pair 52/54 were used, it would not trigger until the lower end of distance L1. The triggering of the timing of presence of the object would be delayed the time it takes for the object to move the distance L2 minus L1. On the other hand, if sensor pair 52/54 inside chute 38 is used, it might be advantageous to place sensor pair 52/54 near the exit 42 of chute 38 for detecting ice jams, because it would minimize of amount of ice stuck in the chute and, therefore, minimize the amount of time to clean the jam. The jam would likely start at the narrowest part of the chute (near exit end 42) and, thus, placement of sensor 52/54 nearer that end 42 would trigger the timing algorithm sooner and likely result in a smaller ice jam before motor 36 is turned off.

Figure 5:
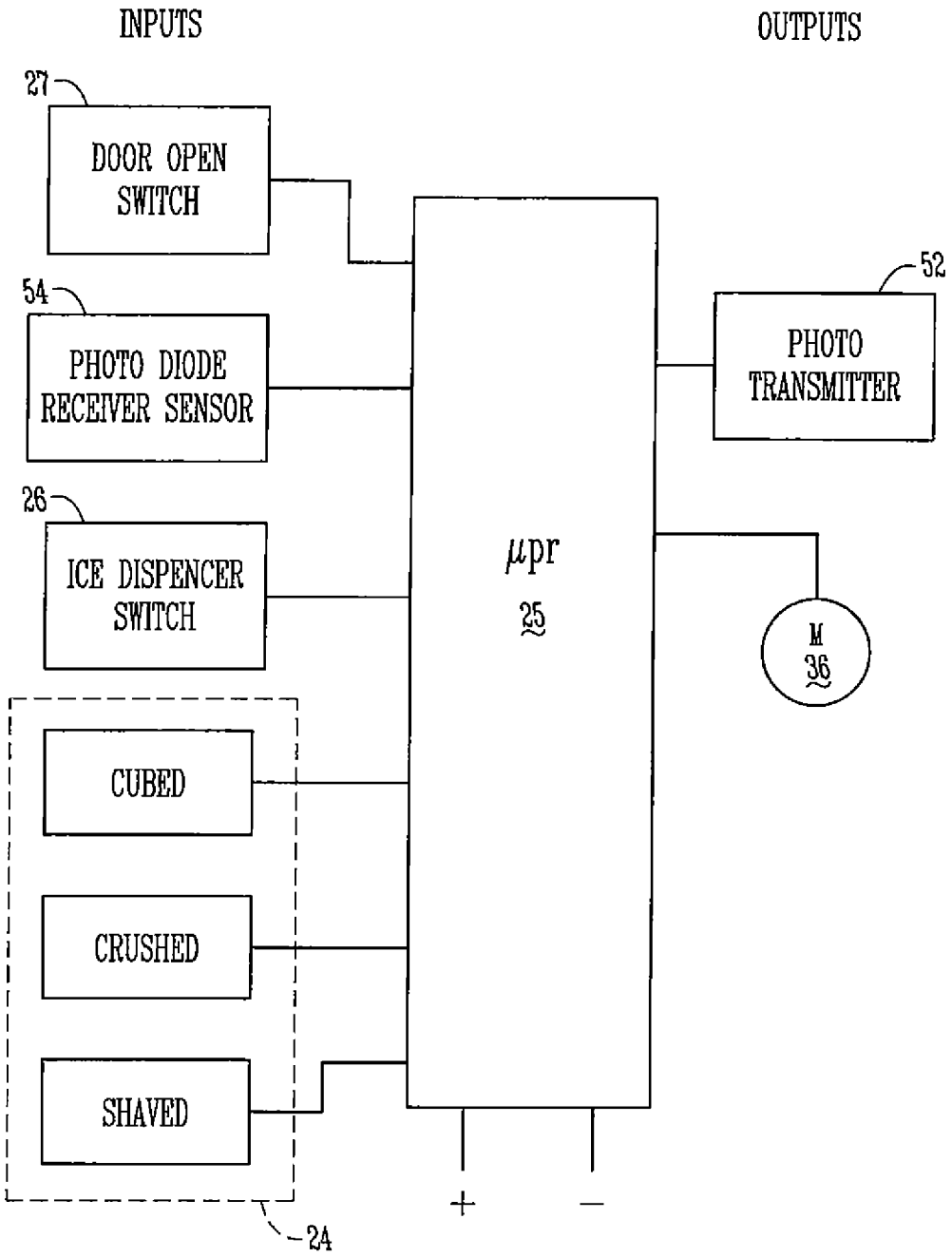
FIG. 5 is a block diagram of electrical and electronic components for the optical sensing system of the simplified diagram of FIG. 2.

FIG. 5 shows a block diagram form of an electrical circuit according to this exemplary embodiment. Controller 25 can be any of a variety of commercially available microprocessors or programmable logic controllers (PLCs). Controller 25 can be the programmable device that controls other functions of the refrigerator/freezer 10 or a dedicated controller.

For example, not only could emitter and receiver 52 and 54 be operatively connected to controller 25, ice dispenser lever or switch 26 (as well as user-selectable "cubes", "crushed" or "shaved" buttons on control panel 24) can be inputs to controller 25. An additional input could be a door open switch 27 which could let controller 25 know if door 18 is open. If so, controller 25 could, in one embodiment, disable or turn off motor 36 regardless of optical sensing system 50.

Transmitter 52 and receiver 54 (or 52' and 54') can be any of a number of commercially available photo emitter/detector pairs. Examples of photo sensors and photo emitter/detector pairs can be found at U.S. Pat. No. 6,314,745. In this embodiment, the pair 52/54 would be sealingly positioned along chute 38. They would not materially obstruct flow of ice in any form along chute 38 but would have clearance to project and receive beam 56 across chute 38 (or beam 56' between items 52' and 54'). Electrical connections and wiring from the emitter and receiver to system 50 can be insulated and sealed from moisture. System 50 can include components or circuitry that is compatible and correlated with emitter and receiver 52 and 54 to provide sufficient operating power to emitter 52. System 50 can be calibrated to trigger when light energy detected at detector 54 is attenuated below a certain threshold level. System 50, on that trigger, would issue an output signal readable by controller 25 as indicating a sensing of presence of an object between emitter/receiver pair 52/54.

FIGS. 6-9 illustrate a method of operation of the apparatus described above.

Figure 6:
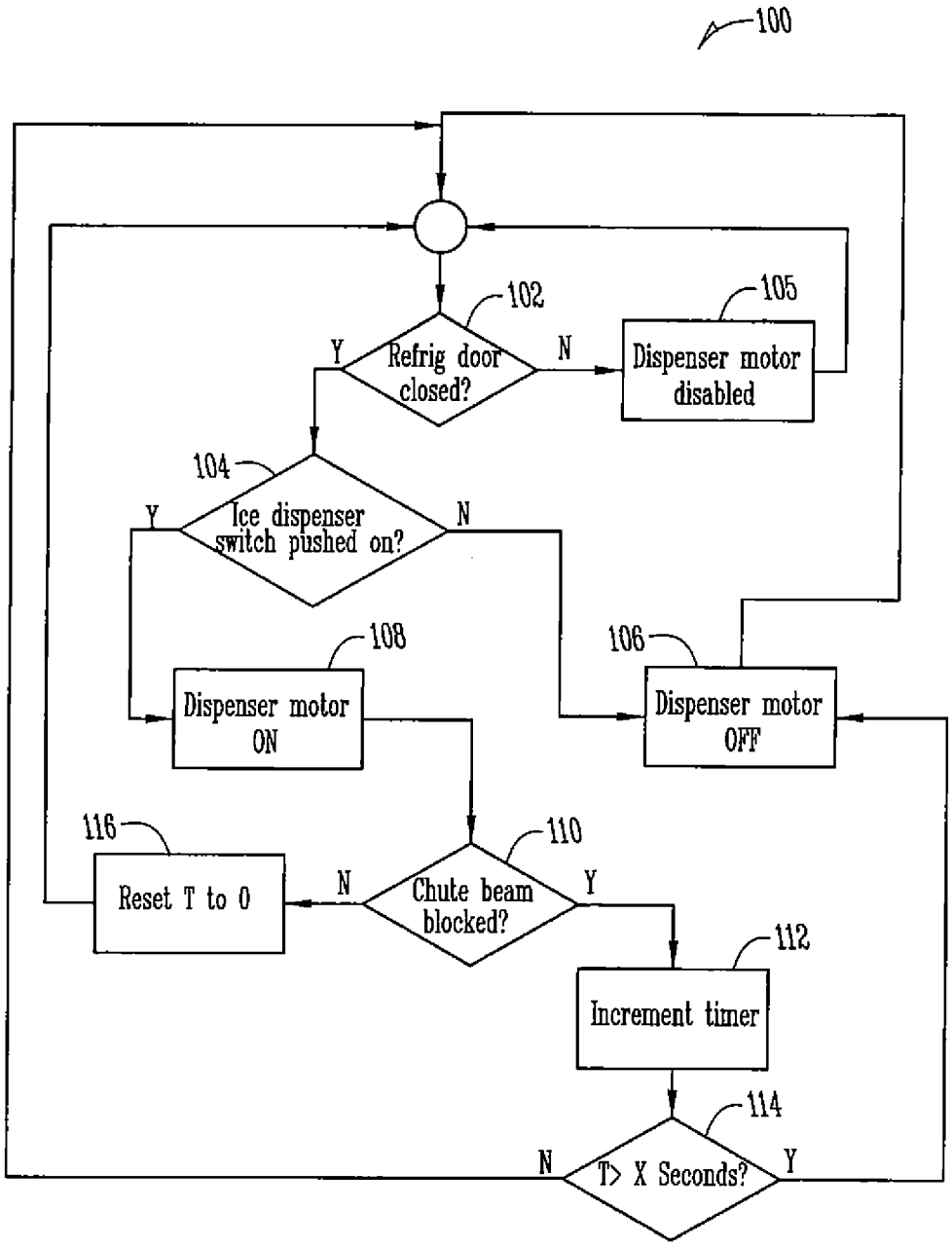
FIG. 6 is a flow chart of software programming for operation of the system of FIG. 5.
Figure 7:
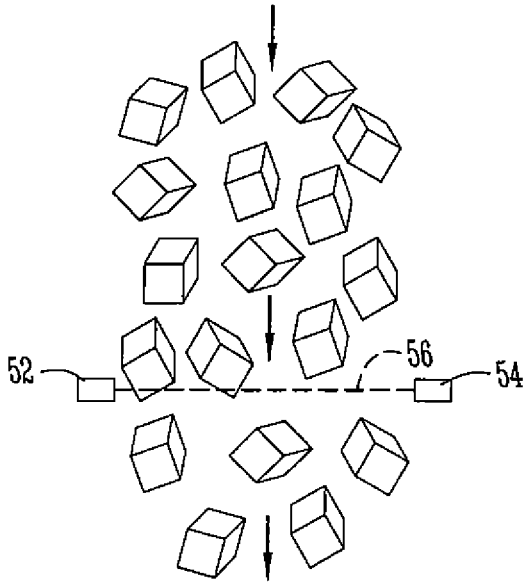
FIG. 7 is a diagrammatic illustration of one mode of operation of the optical sensing system of FIG. 2.

As indicated at FIG. 6, when power is provided to refrigerator freezer 10, controller 25 would check if freezer door 18 is closed (e.g., is switch 27 closed?) (see step 102). If not, dispenser motor 36 would be disabled (step 105) even if a user pressed ice dispenser switch 26.

However, if switch 27 is closed, indicating door 18 is closed, the program waits until ice dispenser switch 26 is pushed on (step 104). If so, dispenser motor 36 is switched on (step 108). However, the algorithm 10 monitors light sensor receiver 54. If a signal from sensor 54 is received corresponding to sensing of the presence of an object (step 110), a timer in incremented (step 112). If sensor 54 indicates presence of an object for greater than X seconds (step 114), dispenser motor 36 is made inoperable or turned off (step 106). In this embodiment, X is a value between approximately 1 and 2 seconds.

The algorithm will continue to check sensor 54 after an initial indication of the presence of an object, but also continue to operate dispenser motor 36 (steps 108, 110, 112, and 114) until the X seconds limit is reached. Controller 25 would issue an instruction to deactivate or turn off motor 36 (step 106) if T>X is reached. The system assumes an object is in chute 38 and has remained there for over the X seconds. The system assumes this is an unwanted condition and turns motor 36 off so no moving parts in ice dispenser 30 are moving and ice does not continue to be dispensed.

On the other hand, note that if there is an initial sensing of presence of an object by sensor 54 (step 110), the algorithm increments timer (step 112), but if the object discontinues to be sensed before expiration of X seconds, dispenser motor 36 (step 108) would continue to operate. There would be no interruption in dispenser motor 36. The system assumes there is no unwanted condition if the object is not present for greater than X seconds (e.g., 1 to 2 seconds). An example would be falling ice cubes, which might block beam 56, but not for more than a fraction of a second.

Once the sensor beam is indicated as unblocked, the timer would be reset to 0 (step 116). The algorithm would continue to operate dispenser motor 36 (step 108) until either the ice dispenser switch 26 is released (step 104) or the refrigerator door is open (step 102).

Figure 8:
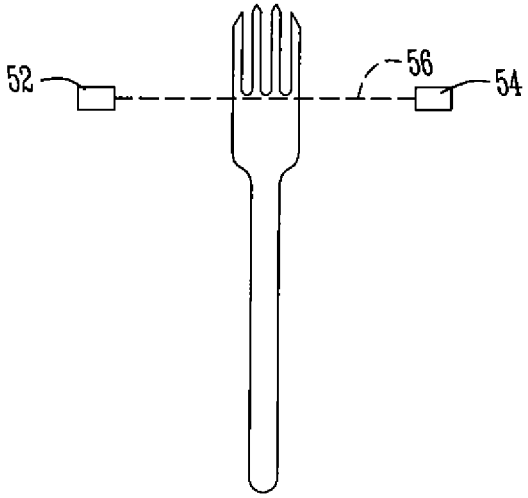
FIG. 8 is a diagrammatic illustration of another operating mode of the optical sensing system of FIG. 2.
Figure 9:
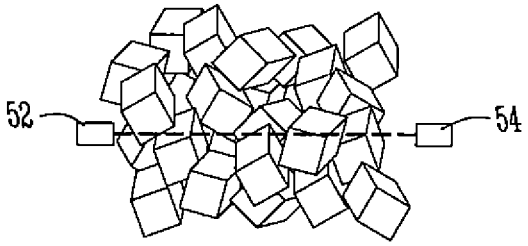
FIG. 9 is a still further mode of operation for the optical sensing system of FIG. 2.

As can be appreciated, algorithm 100 of FIG. 6 can provide the following function. If the user begins operation of the ice dispenser motor 36 by depression of lever 26, as illustrated diagrammatically in FIG. 7, in normal operation the ice (here ice cubes) would pass through beam 56. The value of time X would be selected or calibrated so that it is large enough that ice cubes, shaved ice, or crushed ice can pass in pieces in a relatively continuous fashion through beam 56 without creating a false stop. On the other hand, as illustrated in FIGS. 8 and 9, a solid, larger individual object (e.g. a knife, fork, spoon—FIG. 8) or a collection of non-moving objects (e.g. ice cubes, shaved ice, or crushed ice that is plugged in the ice chute—FIG. 9) would trigger a dispenser motor stoppage if its presence is sensed for >X seconds.

In the preferred embodiment, time X can be between approximately 1 and 2. This is believed to be adequate to meet the rule. A somewhat continuous flow of ice cubes or even crushed or shaved ice would not be deemed by the system as having a continuous beam blockage for greater than that number of seconds as there would generally be spaces where the light detector 54 would see beam 56 between those pieces. On the other hand, insertion of silverware or a blockage of cubes, crushed ice, or shaved ice, would create normally a continuous block for greater than that number of seconds and cause automatic stoppage of the dispenser motor and continued dispensing of ice.

As can be appreciated, the algorithm is intended to differentiate between non-wanted events and wanted events. A wanted event is normal dispension of ice cubes, crushed ice, or shaved ice. An unwanted event can be, for example, the presence of objects such as shown in FIGS. 8 and 9.

As can be appreciated by those skilled in the art, the foregoing exemplary embodiment is by way of example only and not by way of limitation.

For example, a variety of sensors could be used. One example is a capacitive sensor. It could be calibrated to sense the presence of an object, e.g., whether silverware, or clogged ice. Capacitive sensors are well known and commercially available. An example of such technology can be found at U.S. Pat. No. 7,084,643. Other types of sensors could include but are not limited to thermal, electromagnetic, optical, non-ionizing, acoustic, or motion sensors.

Variations obvious, after the benefit of this disclosure, to those skilled in the art will be included within the invention.

What is claimed is:

1. A method of automatically turning off an electrically-powered ice dispensing actuator in an interior of a cabinet of a food-storing refrigeration appliance upon detection of an unwanted condition at or near a distal opening of a conduit or pathway leading from an external ice dispensing station towards the actuator on a door to the interior of the cabinet comprising:

a. turning the actuator on;

b. sensing the presence of one or more objects at or near the distal opening of the conduit or pathway comprising non-contact sensing at least substantially across the distal opening in at least one direction;

c. calibrating a sensor for the sensing at or near the distal opening to i. be sensitive to and turn the actuator off if the sensed presence of an object is indicative of the one or more objects blocking the conduit or pathway or entering the conduit or pathway through the distal opening, but ii. be insensitive to objects moving through the conduit or pathway towards the distal opening by gravity;

iii. wherein the calibration comprises a cumulative time value, the cumulative time value measured by a timer that cumulates incremental time beginning at first sensing of an object by a sensor and continuously or periodically sensing for presence of that object, the cumulative time value correlated to either (a) size of object exceeding maximum size of ice pieces normally expected to be dispensed or (b) clogging of the conduit or pathway with ice pieces, wherein the actuator is disabled when the cumulative time value exceeds a threshold, the threshold being approximately 1 to 2 second(s).

2. The method of claim 1 wherein the sensing comprises producing an output signal in response to sensitivity to a measured property indicative of presence of an object.

3. The method of claim 2 wherein the measured property comprises attenuation of emitted light energy from an emitter sensed by a detector of light energy.

4. The method of claim 2 wherein the sensed presence indicative of an unwanted condition comprises length of time of sensed attenuation of emitted light energy.

5. The method of claim 2 wherein the sensing comprises optical sensing.

6. The method of claim 5 wherein the measured property comprises change in light level.

7. The method of claim 1 further comprising enabling the actuator to turn on again if the indication of an unwanted condition ceases.

8. The method of claim 7 wherein the ceasing of the unwanted condition comprises discontinuance of the sensed presence of the object.

9. The method of claim 1 wherein the ice pieces comprise one or more discrete pieces of cubed, crushed, or shaved ice.

10. The method of claim 9 wherein a cumulative time value is selected to correspond to a largest estimated dimension of the ice pieces.

11. The method of claim 1 further comprising making the sensing insensitive to the moving ice pieces.

12. The method of claim 1 wherein the sensing is non-contacting sensing of the ice pieces.

13. The method of claim 1 wherein the sensing is non-mechanical.

* * * * *